United States Patent [19]

Mäkipirtti

[11] 4,242,124

[45] Dec. 30, 1980

[54] PROCESS FOR THE SELECTIVE REMOVAL OF IMPURITIES PRESENT IN SULFIDIC COMPLEX ORES, MIXED ORES OR CONCENTRATES

[75] Inventor: Simo A. I. Mäkipirtti, Nakkila, Finland

[73] Assignee: Outokumpu Oy, Outokumpu, Finland

[21] Appl. No.: 50,689

[22] Filed: Jun. 21, 1979

[30] Foreign Application Priority Data

Jun. 26, 1978 [FI] Finland ..... 782034

[51] Int. Cl.[3] ..... C22B 1/08; C22B 1/10

[52] U.S. Cl. ..... 75/6; 75/7; 75/9; 75/113

[58] Field of Search ..... 75/110, 7, 6, 9, 113, 75/23, 1

[56] References Cited

U.S. PATENT DOCUMENTS

| | | | |
|---|---|---|---|
| 892,110 | 6/1908 | De Alzugaray | 75/6 X |
| 1,671,003 | 5/1928 | Baghdasarian | 75/113 |
| 3,817,743 | 6/1974 | Sardisco | 75/72 X |
| 3,857,767 | 12/1974 | Gabler et al. | 75/7 X |
| 4,092,152 | 5/1978 | Bórbely | 75/7 |

*Primary Examiner*—G. Ozaki

*Attorney, Agent, or Firm*—Brooks, Haidt, Haffner & Delahunty

[57] ABSTRACT

A process for the selective removal of the impurities, arsenic, antimony, selenium, tellurium and bismuth, present in sulfidic complex or mixed ores and concentrates or industrial precipitates containing similar minerals, by breaking up and rearranging, at an elevated temperature of 600°–900° C. and a high partial pressure of at least 0.2 atm of elemental sulfur, the minerals present in the raw material, in order to cause the formed new impurity compounds to pass into the gas phase, wherein the rearranging is carried out in a gas atmosphere which, in addition to sulfur, contains a sulfur halide in order to halogenate the impurity compounds which have passed into the gas phase, to form stable halides which no longer affect the vaporization equilibrium.

7 Claims, 7 Drawing Figures

PROCESS FOR THE SELECTIVE REMOVAL OF IMPURITIES PRESENT IN SULFIDIC COMPLEX ORES, MIXED ORES OR CONCENTRATES

BACKGROUND OF THE INVENTION

The present invention relates to a process for the selective removal of the impurities, e.g. arsenic, antimony, selenium, tellurium and bismuth, present in substantially sulfidic complex and/or mixed ores and concentrates or technical precipitates which contain similar minerals, by breaking up and rearranging, at an elevated temperature and at a high pressure of elemental sulfur, the minerals present in the raw material, in order to cause the new impurity compounds produced in the rearranging to pass into the gas phase.

The present invention relates in particular to a process for the removal, before the metallurgical refining of the principal metals, of metals which are to be regarded as impurities in relation to the principal metals present in primarily sulfidic complex and mixed ores and concentrates. The bulk of these elements, which are bound in the sulfides of copper, nickel, cobalt and iron as complicated and stable complex structures, consist of arsenic, antimony and bismuth. The scope of the invention also covers a large number of elements which independently form complex minerals or lie in the lattices of others. Such elements include Se, Te, Ga, In, Tl, Ge, Sn, Pb, Zn, Cd, Hg, Mo, Mn, Re, Ag, and Au.

Arsenic, antimony and bismuth cause very great problems in the metallurgy of copper and nickel. In pyrometallurgical processes the compounds of these components, being easily dissociable to metals, are carried along throughout the processing of the principal metals. Efforts are made during each process stage to remove these components, since, when left in the raw metal, they complicate the purification of the raw metal and, when left in the final product even in very small concentrations, they lower the grade of the product.

The impurities contemplated are usually stacked with the principal metal as complicated complex compounds, and therefore the pretreatment of the ore or concentrate by vaporization annealing or, for example, selective froth-flotation does not produce results. Neither are processes for the selective leaching of the components successful, either for the above reasons or for thermodynamic reasons due to the impurity metals themselves.

In the production of copper by conventional processes (reverberatory smelting, sulfide conversion, electrolysis), part of the arsenic, antimony and bismuth present in copper concentrates can be removed. However, in order to obtain a satisfactory final result, purification operations must be included in each process stage. This naturally leads to difficult and uneconomical treatments of solid and molten phases, to large quantities of intermediate products, and, respectively, to the production of circulating loads which limit the capacity of the equipment.

Continual attempts have been made to improve the techniques of removing the impurities at various process stages. In connection with the production of sulfide matte the removal of the impurity components under discussion can be influenced by a suitably selected smelting technology. In shaft, reverberatory and electric-furnace smelting, approx. 50% of the said impurities present in the feed remain in the sulfide phase. In suspension processes, especially in the production of sulfide mattes rich in valuable metals (strong suspension oxidation), the results obtained are considerably better than those mentioned above, especially as regards arsenic and bismuth. Some examples of the suspension processes are the processes according to U.S. Pat. Nos. 3,754,891, 2,506,557, 3,555,164, and 3,687,656 and the processes analogous to them.

Development over recent years has made it possible to increase the separation of the impurities under discussion per apparatus at the conversion stage from the conventional values (70–75%) to values above 90%. The separation has been improved by, for example, combining the impurities, by oxidizing them, by using alkali or iron oxides, to form stable compounds which can be separated in a melt. Owing to the mixing conditions and other conditions, these commonly used processes are costly and their efficiency is low. For example, metals As, Sb, Bi, Pb, Zn, Fe, Co and Cu can be removed quantitatively from the sulfide melts following the conversion of iron. The development over recent years in this area is illustrated by, for example, the processes for the chlorination of nickel (U.S. Pat. No. 3,802,870) and copper (U.S. Pat. No. 4,054,446) sulfide melts.

From the nickel sulfide melt the impurities Fe, Co, and Cu, for example, can be removed by extraction with a chloride mixture melt (750°–900° C.). Sufficiently pure nickel can be blasted directly at a high temperature from the melt ($Ni_3S_2$) obtained as a product.

In attempts at removing impurity metals (Zn, Bi, Pb, Sb, As) from a copper sulfide melt (1150°–1200° C.) by halogenation, the activity of copper in the melt must be lowered in order to prevent the copper from being chlorinated, by adjusting the composition of the melt to the sulfur-rich side of the $Cu$-$Cu_2S$ solubility gap. Simultaneously the activity of the impurity metals increases, and their selective halogenation becomes possible. In carrying out the process, the absence of a gap in the solubility of the sulfide and chlorine of copper is of considerable importance for its kinetics.

The halides of many heavy-metal impurities are thermally so stable that, for example, at temperatures of 1600°–1800° C. a large quantity of impurities can be halogenated into the gas phase from melts containing Cr-CO, Ni-Fe (U.S. Pat. No. 4,006,013). In this case the activities of the principal metals must also be lowered, in order to prevent halogenation, by adjusting the quantity of carbon in the melt and, when necessary, also the hydrogen pressure in the system. In the pre-purification of the raw metal in an anode furnace the same techniques are used as in the conversion. It should be noted that in metal melts the activity condition of the impurity metals under discussion are very disadvantageous, and so the removal of impurities which have passed into the metal melt is highly uneconomical by current methods.

Halogenation processes have been subjected to a great deal of research also as regards the recovery of the principal metals of solid sulfidic and oxidic ores in the form of halides, for example, for hydrometallurgical refining. The halogenation of the principal components from sulfides at 600°–700° C. is not, however, very selective. The mechanism of the processes is slow and inhibited (the sulfides have surface layers consisting of molten and solid halides). The following publications describe the fundamentals of halogenation: H. H. Kellogg: J. of Metals, Trans. AIME, 188, 1950, 862; R. Richte: Die Thermodynamischen Eigenschaften der Metallchloride, VEB Verlag Technik, Berlin, 1953; J.

Gerlach, D. Papenfuss, F. Pawlek, R. Reihlen: Erzmetall, XXI, 1968, 9; J. K. Gerlach, F. E. Pawlek: Trans. AIME 239, 1967, 1557; R. J. Fruehan, L. J. Martonik: Met. Trans. 4, 1973, 2789–2797. The very recent separation processes, worth mentioning, based on the halogenation of metals include the separation of the nickel and copper of silicate and ultrabasic ores by the so-called segregation roasting or its derivatives (an alkali or earth-alkali chloride and carbon halogenation-reduction system): A. A. Dor: The Metallurgical Society of the American Institute of Mining, Metallurgical, and Petroleum Engineers, Inc., New York 1972, 1–310.

The purification of the products of the roasting of pyrites and sulfurous pyrite, consisting of a great number of various methods, should also be mentioned. The object is to remove the sulfur, arsenic and antimony, as well as valuable metals, from the calcine, in which case the treated calcine is a suitable raw material for iron production. The processes are usually one- or two-stage oxidation and reduction processes, nearly always involving a sulfating, chlorinating or vaporizing roasting. Fluidized-bed furnaces are generally used for the implementation of the processes. The processes according to U.S. Pat. No. 3,649,245 and Canadian Pat. Nos. 890,343, 876,030, 885,378 and 882,585 are examples of the latest state of the art.

The object of the present invention is to provide a process for a more selective and more economical vaporization of the impurities present in complex and mixed ores.

SUMMARY OF THE INVENTION

In the process according to the invention, the compound and/or lattice structure of often highly complicated complex minerals is broken up, and simultaneously both the principal and the impurity metals of the minerals are rearranged to form minerals which are simple in both structure and composition. According to the process disclosed in Canadian Pat. No. 1,057,510, the rearranging of the minerals is carried out by very strongly catalysing the solids diffusion of metals and also sulfur within the temperature range 600°–800° C. by means of a high partial pressure of elemental sulfur. The minerals form stable sulfides corresponding to the new conditions. Depending on the temperature and the quantities of material, some of the impurities (in themselves highly valuable and in part rare elements) vaporize as sulfides or in pure form in accordance with their vapor pressure.

It has now been observed surprisingly that the vaporization efficiency of the independent impurity metals or their compounds, formed by sulfidization, can be improved by altering the mechanism of the vaporization. In carrying out the sulfidization, the gas-phase volumes are low, since the process requires a high partial pressure of sulfur, and thereby the gas phase is rapidly saturated, especially with impurities with a low vapor pressure, or with compounds of the impurities, and the vaporization stops. In the process according to the invention these impurity components, which vaporize and pass into the gas phase, are converted to inert form, whereby their effect on the vaporization mechanism is altered and the vaporization continues uninterrupted at the complete pressure gradient. This conversion to inert form is carried out by converting the volatile impurity components to stable gaseous halides, which thereby also have a very low dissociation pressure. The halogenation process is made possible, for example, by the observation that conversion in a gas phase is quantitative when a halogen quantity is stoichiometric in relation to the quantities of impurities and, furthermore, it is so rapid that halides of solid principal-metal sulfides cannot form. Within the temperature range of the process the kinetics of the principal-metal sulfides are determined not only by the thermodynamic conditions but also by either the vaporization rate of the halide (thermal activation approximately the same as the heat of vaporization of the halide) or counter-current gas diffusion (low temperature effect), which are both of insufficient velocity. The elevation of the vapor pressures of the impurity components by means of increasing the processing temperature is difficult by using a mere sulfidization process, owing to the low melting ranges of both complex and product sulfides. In particular, copper minerals which contain compounds of zinc and lead, and also corresponding nickel and cobalt minerals, have low melting ranges.

The chlorination of various minerals and calcines in order to convert the impurities present in them to easily vaporizing compounds and their removal by vaporization is known per se. However, the present invention is not based on solid-phase chlorination but on the conversion of the impurity sulfides, already caused to pass into the gas phase, to inert compunds which no longer affect the vaporization equilibrium. The chlorination of the solid phase does not in itself involve anything novel and, on the contrary, the objective is to avoid it in the present process, since the halogenation of the solid phase would not be as selective as the present process, in which only the impurity compounds present in the gas phase are substantially halogenated.

The sulfidization and halogenation are preferably performed at 600°–900° C. in a gas atmosphere in which the partial pressure of sulfur is at minimum 0.2 atm, and halogen is added to the gas atmosphere in a proportion which is preferably at minimum approximately 80% of the quantity required for the complete halogenation of the impurities. The halogen can be chlorine, fluorine or a sulfur compound of the same.

Furthermore, the present invention has the surprising characteristic that the thermal balance of the process can be regulated in a simple manner by feeding into the gas atmosphere at least two different halogens or halogen compounds, or a mixture of the same at a certain mutual proportion, which can be selected by an expert in the field on the basis of the description below.

Sulfur from which the impurity components have been removed can be recycled into the process, which makes the present process highly economical.

Thus in the process according to the invention the object is to remove, from mainly sulfidic complex and mixed concentrates or ores, the impurity metals present in them, detrimental to the refining of the principal metals. These impurity metals (e.g. As, Sb, Bi, Se, Te, etc.) are often combined with the sulfides of the principal metal (Cu, Ni, Co, Fe, Zn, Pb), forming complicated complex compounds as regards both the mineral structures and compositions.

BRIEF DESCRIPTION OF THE DRAWINGS

In the accompanying drawings:

FIG. 3*a* shows an untreated mineral specimen. FIG. 3*b* shows a mineral sulfidized under conditions according to the invention. FIG. 3*c* shows the product structure when a quantity of chlorine corresponding to the impurity chlorides was added to the gas phase under conditions otherwise corresponding to those of FIG. 3*b*.

DESCRIPTION OF THE PREFERRED EMBODIMENTS

Figure 1:
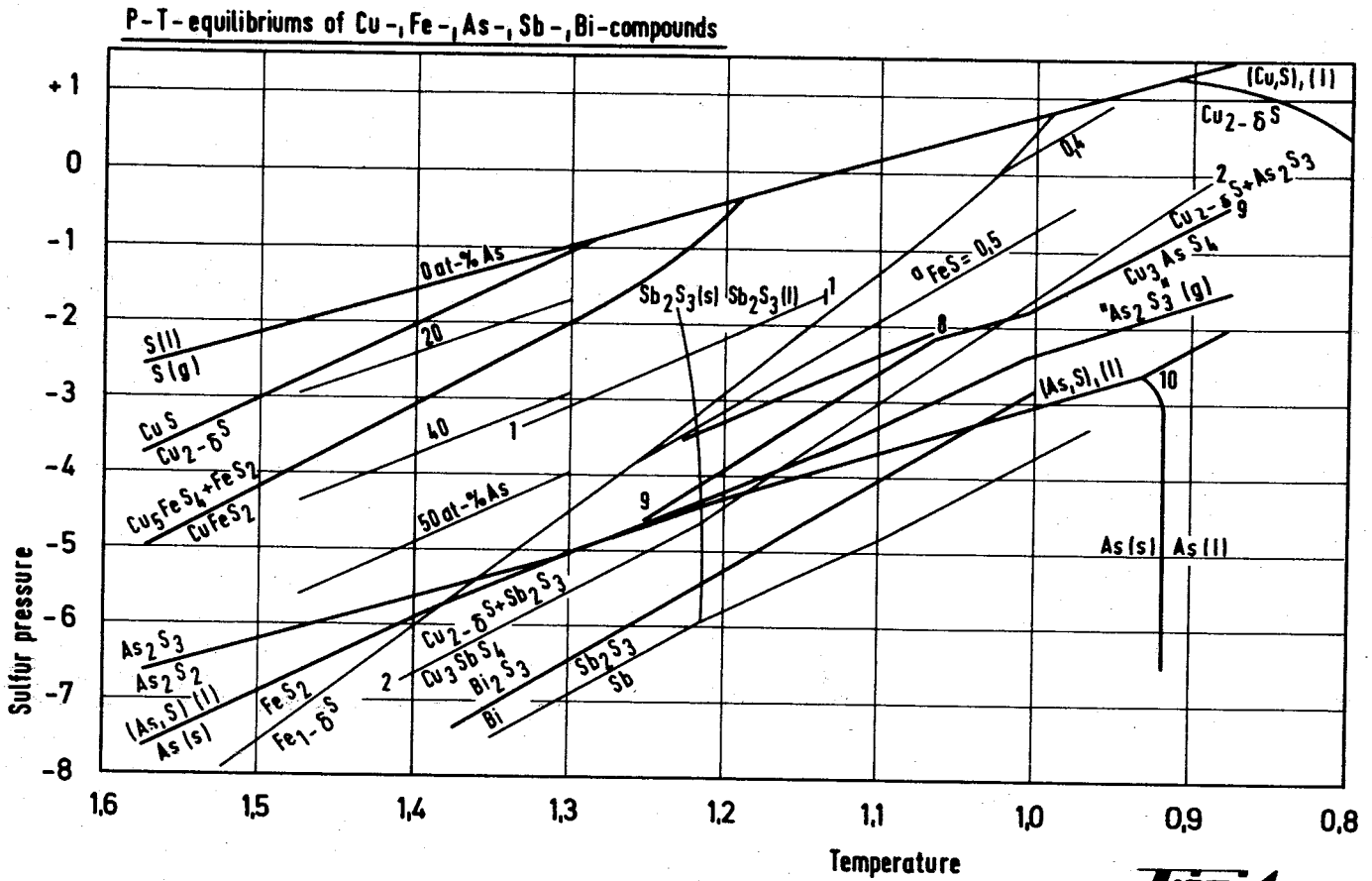
FIG. 1 is a diagram showing the stability ranges of the system Cu-Sb-S as functions of temperature and sulfur pressure.

The new process comprises a two-stage operation carried out simultaneously in one process stage:

(1) The impure concentrate is treated, in accordance with the sulfidization process disclosed in Canadian Pat. No. 1,057,510, at a high partial pressure of sulfur vapor ($P_{S2}\sim 0.2$–$1.0$ atm) and within the temperature range 600°–900° C. Thereby the complex structure of the concentrate breaks up, and both the principal metals and the impurity metals form independent stable sulfides. Some of the sulfides formed by the impurity metals can be vaporized quantitatively during the processing (e.g. $As_xS_y$ compounds above their boiling point ranges: 700°–725° C.), and some of these sulfides pass into the gas phase as a function of the vapor pressure corresponding to the temperature and pressure conditions (e.g.: $Sb_2S_3(s,l)\rightarrow SbS(g)+\frac{1}{2}\ S_2(g)$; T°C./P atm: 600° C./$(4.97)^{\pm 1}p=7.42\times 10^{-4}$, 800° C./$(4.30)^{\pm 1}p=7.42\times 10^{-2}$). The vaporization of the impurity sulfide above the temperature range corresponding to the sulfidization process, where the vapor pressure would be sufficient, is usually impossible owing to the low melting range of the sulfide mixture.

(2) When the sulfidization process (1) is being carried out, the gas phase thereby becomes saturated with heavy-metal vapors containing the impurities or with sulfur compounds of the same (a large part of the impurity sulfides do not vaporize congruently but are dissociated into a number of both metallic and metal sulfide compounds, the composition and equilibriums of which are unknown) and the vaporization stops. The new process is based on the fact that an impurity or its compound passing into the gas phase as a result of sulfidization is made inert in relation to the vaporization mechanism, and thereby the sulfidizing vaporization is continuous and occurs all the time at the full pressure gradient. They are made inert by converting directly to halides, i.e. stable chlorides and/or fluorides, the impurities and their compounds which have passed into the gas phase. The use of halogens for the conversion of the impurities in the gas phase is based on the following observations, among others:

a. In the gas phase the impurity halides are practically undissociable.

b. The stability difference between the impurity halides and the principal-metal halides is so great that the selective halogenation of the impurity components is possible.

c. The effect of a halogen (combines immediately, forming sulfur halide) in the gas phase on a gaseous impurity component is so rapid and quantitative that the added halogen leaves the gas phase immediately in a combined form and thus does not halogenate a solid sulfide which contains the principal metal (although the thermodynamic conditions are suitable for this).

d. Usually the impurity halides which are most detrimental in relation to the principal metal are the most stable ones, and therefore it is possible to regulate the halogenation to a considerable degree.

c. The halides of the impurity components are usually gaseous up to such low temperatures that a quantitative separation of the gas phases from the solidifying sulfur is possible, and the sulfur is sufficiently pure to be recycled in the process.

The ores within the scope of the process according to the invention are naturally the same as those which can be processed by the structural conversion and vaporization process for complex minerals, based on sulfidization, known from Canadian Pat. No. 1,057,510.

Heavy and easily vaporizing impurity metals with a high ordinal number are present in ore mineralizations formed at low temperatures and pressures. The ores within the scope of the invention thus appear mainly in pegmatitic-pneumatolytic, and especially hydrothermal, mineral and ore mineral formations. In this case the impurities are present either as trace elements in the lattices of the principal-metal sulfides or directly in the multiform complex minerals of the structural parts.

Classified according to the composition, the groups of, for example, hydrothermal minerals are as follows:

a. Pyritic and arsenic-rich groups:
$(Fe, Co, Ni)(As, Sb, Bi)_{1\text{-}2}(S, Se, Te)_{0\text{-}2}$ b. Lead, zinc and silver groups:
$(Cu, Ag)_{20}(Fe, Zn, Hg, Ge, Sn)_4(As, Sb, Bi)_8S_{26}$
$(Zn, Cd, Hg)(S, Se, Te)$
$Pb(S, Se, Te)$ c. Tin, zinc and silver groups:
$Cu_3(As, Sb, Fe, Ge, V)S_4$
$Cu_2(Ag, Fe, Zn, Sn)S_2$ d. Cobalt, nickel, silver, bismuth and uranium groups:
$(Co, Ni, Ag, U)(As, Bi)_3$ e. Groups of arsenic, antimony and bismuth complex minerals:
$Ag_{1\text{-}3}(As, Sb)S_{2\text{-}3}$
$Cu(As, Sb, Bi)S_{2\text{-}3}$
$(Pb, Cu)(As, Sb, Bi)_3$ Many impure metal and metal-compound precipitates and powders produced as byproducts of the metallurgical industry also, of course, belong to the group of materials which can be treated by the process according to the invention.

A hydrothermal fahlerz series formed at a low temperature, of the following general form $(Cu,Ag)_{20}{}^{+1}(Fe,Zn,Hg,Ge,Ga,In,Sn\ldots)_4{}^{+2}(As,Sb,Bi)_8{}^{+3}(S,Se,Te)_{26}{}^{+2}$ is discussed below in order to elucidate the funtamentals of the process according to the invention.

The series includes highly impure complex minerals of copper. Their melting ranges are usually at low temperatures, and therefore it is very difficult to remove, by conventional metallurgical processes (smelting, roasting, leaching), the impurities which complicate the refining of the principal metal (Cu, Ag).

By treating the minerals of the series by means of sulfur vapor at a high partial pressure ($P_{S2}=0.2$–$1.0$ atm), it is possible to cause the structures of the minerals to break up, the compounds forming independent sulfide minerals which are stable at the treatment temperature (600°–800° C.). The sulfides obtained as products of the sulfidization of the fahlerz include: $Cu_{2-\delta}S$, $Cu_5FeS_4$, $CuFeS_2$, $Fe_{1-\delta}S$, $FeS_2$, $Ag_{2-\delta}S$, (Zn—,Fe)S, HgS, $GeS_2$, $SnS_2$, $Ga_2S_3$, $In_2S_3$, $As_2S_3$, $Sb_2S_3$, $Bi_2S_3$, in which part of the sulfur has been replaced by selenium and tellurium. Some of the heavy metals (Ga, In, etc.) can also replace iron in copper minerals and, for example, zinc in zinc minerals. The structural-change sulfidization is usually linked with a simultaneous vaporization of the impurities. For example, the vaporization, as sulfides, of arsenic, which is usually present in very large quantities in complex minerals, occurs within the operating range of the process (600°–800° C.) very rapidly and effectively. The vaporization of antimony sulfide, on the other hand, is more difficult to achieve. The vapor pressure of antimony sulfide must be re-elevated by raising the temperature during the mineralization, or thereafter. Experience has shown that even by this procedure the practical vaporization of large quantities of antimony in a one-stage processing unit is not possible. In the cases of fahlerz complexes the raising of the vaporization temperature is usually not possible, owing to the low melting ranges of the basic and product matrices.

For the reasons mentioned above the new process operates at temperatures of the operating range of the sulfidization process. In this case the vaporization of the impurities is possible by converting a volatile impurity or its compound immediately to an inert form, in which case it does not affect the vaporization equilibrium. In the new process this is carried out by halogenating the impurity which has been caused to pass into the gas phase in the sulfidization process, in which case, owing to the great stability of the halide, its dissociation at temperatures of the operating range is so low that it does not affect the vaporization equilibrium of the impurity sulfides. Simultaneously a great number of other advantages are gained as regards the carrying out of the sulfidization process, especially when treating copper minerals.

The sulfidization of Sb fahlerz and the halogenation, with chlorine, of the obtained gas phase are first discussed as an example. Equilibrium diagram 1 shows the stability ranges of the system Cu-Sb-S as functions of the temperature and the sulfur pressure. The following mineral reactions occur during the sulfidization of Sb fahlerz:

tetrahedrite⇄famatinite $$2Cu_{12}Sb_4S_{13}+3S_2(g)\rightleftarrows 8Cu_3SbS_4$$

$$\text{Log } P_{S2}=-9092/T+8.715 \quad (1)$$

The corresponding equilibrium curve is shown in FIG. 1, which depicts the equilibriums of compounds of copper, iron, arsenic and bismuth as functions of the sulfur pressure and the temperature. The formation of a new mineral (famatinite) is very rapid, and so the following solid-melt reactions known from the Cu-Sb-S system are prevented at least in part:

543° C.: $Cu_{12}Sb_4S_{13}\rightarrow Cu_3SbS_4+3Cu_3SbS_3$

588° C.: $Cu_3SbS_4+Cu_3SbS_3\rightarrow 3Cu_2S+\text{melt}$ 607.5° C.: $Cu_3SbS_3\rightarrow\text{melt}$ The basic reaction in the dissociation of famatinite is $$2Cu_3SbS_4\rightleftarrows 3Cu_2S+Sb_2S_3+S_2$$

$$\text{Log } P_{S2}=9727/T+4.073 \log T-4.680 \quad (2)$$

In order to accelerate the reaction and to avoid melt phases, the conversion must be carried out at a high sulfur pressure. In this case the reaction is of the form $$(2-\delta)Cu_3SbS_4\rightleftarrows 3Cu_{2-\delta}S(s)+(1-\delta/2)Sb_2S_3(s,1)+(1-\delta 5/4)S_2(g) \quad (3)$$

It has been observed that an insufficiency of copper in the digenite ($Cu_{2-\delta}S$) formed in the mineralization tends to increase the temperatures of the melting ranges in several systems (a saddle is formed in the phase equilibrium). When observing basic reaction (2), it can be noted that the equilibrium can be shifted to the right by lowering the activities of chalcocite and stibnite. The lowering of the activity of chalcocite is caused by digenite obtained at a high $S_2$ pressure. The equilibrium of the digenite reaction is of the form $$(1-\delta)Cu_2S(ss)+(\delta/2)S(ss)\rightleftarrows Cu_{2-\delta}S(s)$$

$$\text{Log } K=-(1-\delta) \log a_{Cu2S}-(\delta/4) \log f_{S2} \quad (4)$$

$$a_{Cu2S}=-2\delta-203.7/T+1.322$$

$$f_{S2}\sim P_{S2}=\exp[3.072\delta^{-1}+4237\delta^{-1}-4\delta^{-1}(1-\delta) \ln a_{Cu2S}]$$

The composition of digenite and the corresponding sulfur pressure within the operating range of the process can be calculated on the basis of the equilibrium equations (e.g.

917° K., $P_{22}=0.887$ atm, $\delta=0.242$, $Cu_{2-\delta}S=Cu_{1.758}S$ and $a_{Cu2S}=0.619$)

The $Sb_2S_3(s,1)$ (melting point 823° K.) formed as a result of Reactions (2) and (3) is sublimated and passes into the sulfur vapor. The sublimation is, however, quantitatively low since the gas amounts and the sublimation pressures are low in the sulfidization process. Sublimation does not correspond to congruent vaporization, and a large quantity of various Sb-S compounds are produced:

predominant: $(SbS)_{1-2}$, $(Sb_2S_3)_{1-4}$ small amounts: $(SbS)_{3-4}$, $(Sb_{3-4}S_{4-5})$ etc.

Considering sublimation as regards the assumed principal component (SbS), the dissociation equation and the corresponding vapor pressure are obtained:

$$Sb_2S_3(s,1)\rightleftarrows 2SbS(g)+\tfrac{1}{2}S_2(g)$$

$$\text{Log } (P/\text{mmHg})=-(9368\pm 281)T^{-1}+(10.482\pm 0.372) \quad (5)$$

Thus, at 1000° K. the pressure value obtained on the basis of the equation is $$(4.50\pm^{1}\times P=1.71\times 10^{-2}\text{atm.}$$

In order to accelerate the dissociation reactions and to prevent the agglomeration of the product phases ($Sb_2S_3(l)$), the vaporization products of antimony sulfide must be made inert as regards the vaporization equilibriums.

In order to realize an effective vaporization of the antimony compounds and also in order to enhance Reaction (3), the antimony compounds present in the sulfur vapor must be made inert so as to make it possible to vaporize large quantities of antimony compounds rapidly and in an equilibrium into a low sulfur vapor quantity. Taking the compound stability into consideration, the antimony compounds could be made inert by oxide conversion ($Sb_4O_6(g)$). In this case the required oxygen potential would be so high that the sulfur potential would fall below the effective sulfidization pressure, and thereby the reactions would not proceed. By carrying out a number of experiments it could be observed that, on certain conditions, halogens are very effective for combining antimony compounds in a gas phase.

Figure 2:
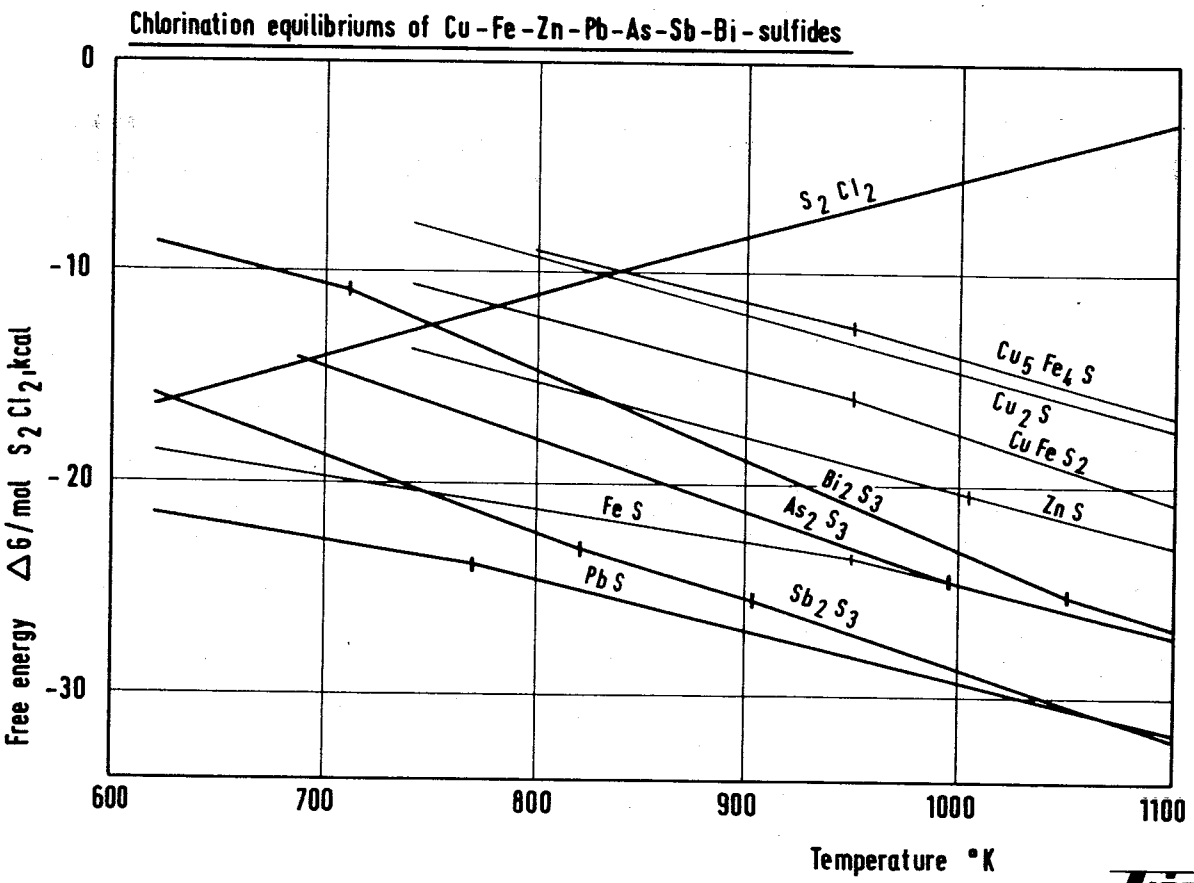
FIG. 2 is a graph showing free energy curves with temperature in degrees Kelvin plotted along the abscissa.

The introduction of halogens into the sulfidizing gas phase leads immediately to the formation of sulfur halide. FIG. 2 depicts, as functions of the temperature, the values of the free energy of the chlorination reactions of some sulfides. It can be observed from the figure that the chlorides of the principal-metal compounds ($Cu_2S$, FeS, ZnS, etc.) are stable in relation to sulfur chloride. Even more stable are, however, the chlorides ($AsCl_3$, $SbCl_3$, $BiCl_3$, etc.) obtained in the sulfide conversion of many impurity metals. According to FIG. 2, it is thus possible, by using a limited quantity of chlorine, to chlorinate the impurity-metal sulfides vaporizing into the gas phase. The sulfide vaporization can in this case be carried out continuously without the gas phase becoming saturated with impurity components. Thus, the chlorination reactions as regards the principal components of the vaporization system Sb-S are $$(1-\delta/2)Sb_2S_3(s,l)+3(1-\delta/2)S_2Cl_2(g) \rightleftarrows (2-\delta)SbCl_3(g)+9/4(2-\delta)S_2(g) \quad (6)$$

$$(2-\delta)SbS(g)+3(1-\delta/2)S_2Cl_2(g) \rightleftarrows (2-\delta)SbCl_3(g)+2(2-\delta)S_2(g) \quad (7)$$

The equilibrium constants calculated per one mole of $S_2Cl_2$ are:

$$Sb_2S_3(s):\ \log k=-3022/T-2.494 \log T+16.823$$

$$Sb_2S_3(l):\ \log k=-3889/T-2.564 \log T+15.977$$

$$SbS(g):\ \log k=10260/T+2.035 \log T-5.032$$

Pure arsenic fahlerz, i.e. tennantite, has a wide composition range at temperatures higher than 300° C. The composition of tennantite corresponds to formula $Cu_{12-x}As_{4+y}S_{13}$, where $0 \leqq x \leqq 1.72$ and $0=y \leqq 0.08$. Tennantite melts at 665° C. with a composition $Cu_{12.31}As_4S_{13}$. When tennantite is treated with sulfur, enargite corresponding to the antimony mineral is obtained:

$$\tfrac{8}{3}Cu_{12}As_4S_{13}+S_2(g) \rightleftarrows 8/3Cu_3AsS_4$$

$$\log P_{S2}=-9072/T+7.634 \quad (8)$$

The maximum melting point (and corresponding composition) of enargite is not known precisely, but it is above the melting point of tennantite. At a high partial pressure of sulfur, enargite reacts, corresponding to reaction equation $$(2-\delta)Cu_3AsS_4(l,s) \rightleftarrows 3Cu_{2-\delta}S(g)+(1-\delta/2)As_2S_3(s,l,g)+(1-5\delta/4)S_2(g) \quad (9)$$

Two compounds of arsenic and sulfur are known, $As_2S_2$ and $As_2S_3$, their melting points being respectively 583°-594° K. and 583°-585° K. The free energy of the formation of an As-S melt is $$2As(s)+S_2(g) \rightleftarrows 2(As,S)(l),$$

$$\Delta G=-46100+34.40T,\ (281°-450°\ C.) \quad (10)$$

FIG. 1 depicts sulfur pressures corresponding to various concentrations of arsenic (% atomic) in the melt. Compared with the corresponding Sb-S system, before the boiling of the compounds the As-S system has a melt range within a wide temperature range. The sulfur pressure of the basic reaction of the dissociation of enargite is, calculated for molten $As_2S_3$, of the form $$\text{Log } P_{S2}=-9201/T+9.926 \log T-21.904$$

The formation reaction of digenite, of course, corresponds to Reaction (4).

In the sulfidization process, a high partial pressure of sulfur is used, in which case the vaporization also operates within the range of S-As melts which are located on the S-rich side of the range of the As-S melting point maximum (708°-723° C.). In this case the minimum pressure of the system (a composition of $\approx As_2S_3$) is approached from a range where the liquid-gas phase range is narrow and the lowering temperature gradient of the gas phase range is also steeper than on the As-rich side of the system.

Since the P-T-X equilibriums of the As-S system are not known, neither are the composition of its vapor phase and the mechanism of the vaporization known. The vaporization is, however, incongruent. A very strong dissociation occurs during the vaporization, and the products contain, among ethers, the following components: $(As_2S_3)_n(g)$, $As_4(g)$, $As_3(g)$, $As_2(g)$, $As(g)$, $S_2(g)$, the equilibrium compositions of which are unknown.

Of the vapor pressure values for pure $As_2S_3$ within the temperature ranges 629°-813° K. (1962) and respectively 729°-966° K. (1965), the following values are mentioned:

$$\text{Log (P/atm)}=-3865/T+4.237$$

$$\text{Log (P/atm)}=-4307/T+4.300 \quad (11)$$

By extrapolation, the values P=2.36 and P=0.98 atm are obtained respectively at 1000° K.

It should be mentioned that the vaporization of the selenides and tellurides of arsenic is also incongruent. The vapor pressures correspond to the following equations:

$$As_2Se_3:\ 926°-1132°\ K.,\ \log P=-5683/T+5.010$$

$$As_2Te_3:\ 1052°-1162°\ K.,\ \log P=-6074/T+4.668$$

(1000° K.: P, atm: $2.12\times10^{-1}/As_2Se_3$ and $3.93\times10^{-2}/As_2Te_3$)

As mentioned above, the compositions and quantities of arsenic or its compounds in gas phase are not known. When using the free energy values of compounds given in Table 7, the following values of free energy are obtained in halogenation for the gas-phase components assumed to be predominant:

$$\tfrac{1}{3}As_2S_3(g)+S_2Cl_2(g)\rightleftharpoons\tfrac{2}{3}As_2Cl_2(g)+3/2S_2(g)$$

$$\Delta G=9696+20.159T\log T-94.741T \quad (12)$$

$$\tfrac{1}{3}As_2S_3(g)+S_2Cl_2(g)\rightleftharpoons\tfrac{2}{3}AsCl_3(g)+4/3S_2(g)$$

$$\Delta G=-16476+1.770T\log T-15.353T \quad (13)$$

$$1/6As_2(g)+S_2Cl_2(g)\rightleftharpoons\tfrac{2}{3}AsCl_2(g)+S_2(g)$$

$$\Delta G=-14240+2.529T\log T-23.346T \quad (14)$$

At 1000° K. the corresponding values of free energy of the equations are: $\Delta G=-24570$, $\Delta G=-26520$ and $\Delta G=-30\,000$ cal, and so the reactions are complete.

It can be observed for the sake of comparison that the free energy of the formation of corresponding fluorine compounds, calculated per the arsenic quantity corresponding to chlorination, is even more negative than those mentioned above:

$$\tfrac{1}{3}As_2S_3(g)+\tfrac{1}{3}SF_6(g)\tfrac{2}{3}AsF_3(g)+2S_2(g)$$

$$\Delta G=-26317+18.935T\log T-94.542T$$

$$(1000°\text{ K.}, G=-64054\text{ cal}/\tfrac{1}{3}As_2S_3(g)) \quad (15)$$

The radiogram series a–c in FIG. 3 illustrates the distributions of components when a concentrate which contains antimony-bearing arsenic enargite, the corresponding fahlerz and iron sulfide is processed.

Figure 3A:
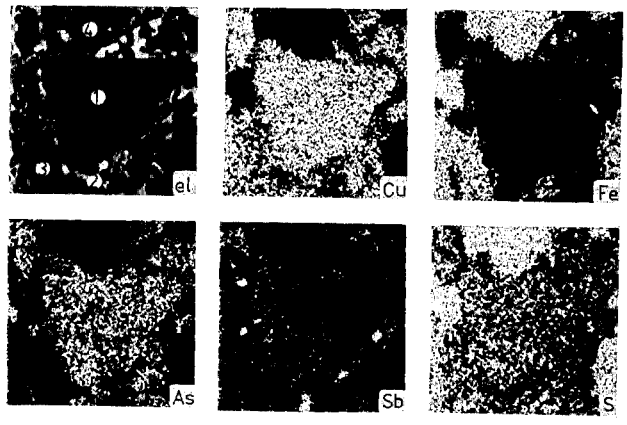
FIGS. 3*a*, 3*b* and 3*c* constitute a radiogram series illustrating the distribution of components when a concentrate which contains antimony-bearing arsenic enargite, the corresponding fahlerz and iron sulfide is processed.

FIG. 3*a* shows an untreated mineral specimen.

Figure 3B:
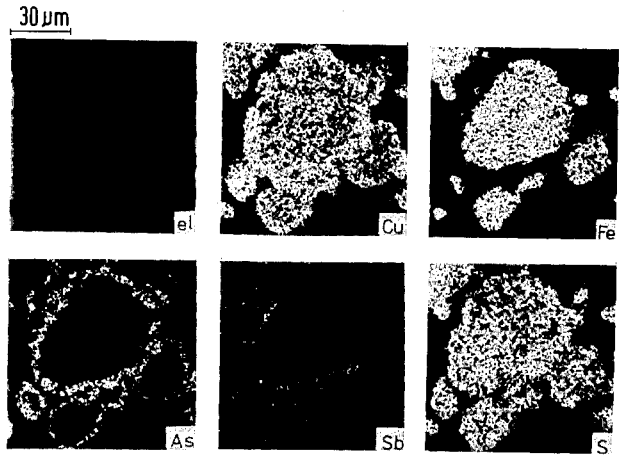

FIG. 3*b* shows a mineral sulfidized under conditions according to the invention. Arsenic and antimony have been completely removed from the inner parts of the particle shown in the figure, and the particle has been converted to a mixture of chalcopyrite and bornite. On the surface of the particle, however, a zone containing As and Sb can be seen. The figure shows a case in which a sulfur gas phase which carries As-Sb-bearing vapors has been saturated. In the sulfidization an attempt is made to keep the gas phase quantity low, in such a manner that the arsenic concentration in the produced polymer is approx. 30–40% As. In this case the concentrated sulfur polymer is easy to store and to refine further. Since the properties and vapor pressures of sulfur compounds formed jointly by arsenic and antimony, as well as other data concerning them, are not available, the state of saturation of the gas phase must nearly always be analyzed experimentally when several impurity components are present.

Figure 3C:
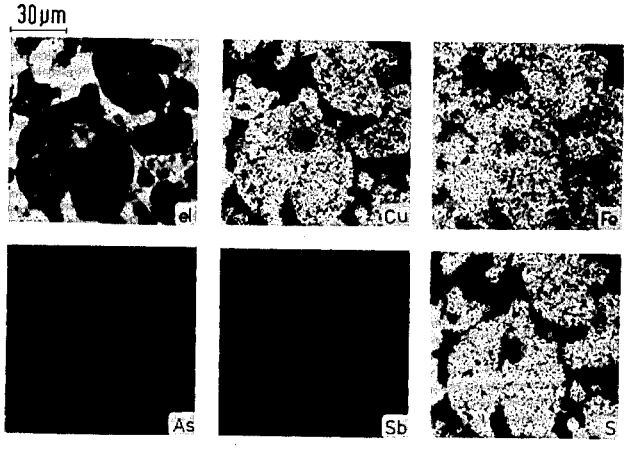

FIG. 3*c* shows the product structure when a quantity of chlorine corresponding to impurity chlorides has been added to the gas phase under conditions corresponding to FIG. 3*b*. Surface zones cannot be seen in the product phases; the impurities have been vaporized quantitatively.

Bismuth does not form an independent fahlerz mineral, so do arsenic and antimony, but it usually replaces antimony, seldom arsenic, in the mineral.

During the sulfidization of a fahlerz, bismuth forms an independent sulfide ($Bi_2S_3$), which dissociates when it sublimates. It is obvious that $Bi_2S_3$ is sublimated analogously to the compounds $Bi_2Se_3$ and $Bi_2Te_3$. Thus it can be assumed that monosulfide and metals are predominant in the gas phase. The following values of free energy are obtained for the gas phase chlorination from the values of Table 7:

$$\tfrac{2}{3}BiS(g)+S_2Cl_2(g)\rightleftharpoons\tfrac{2}{3}BiCl_3(g)+4/3S_2(g)$$

$$\Delta G=-41.476\times T+2.883T\log T-73696 \quad (16)$$

$$\tfrac{1}{3}Bi_2(g)\times S_2Cl(g)\rightleftharpoons\tfrac{2}{3}BiCl_3(g)+S_2(g)$$

$$\Delta G=-47.911\times T+3.672T\log T-73502 \quad (17)$$

At 1000° K. the corresponding free energy values are:

$$\Delta G=-35510\text{ cal and }\Delta G=-36800\text{ cal.}$$

On the basis of the composition equation of fahlerz it can be observed that the pure mineral $Cu_{20}Fe_4As_8S_{26}$ contains iron 7.6% by weight. The minerals accompanying fahlerz often include pyrite, pyrrhotite and many complex, iron-containing sulfides.

From the free-energy diagram, FIG. 2, it can be observed that the values of the free energy of the chlorination of the sulfides of iron and arsenic, for example, are nearly the same. In this case it could be possible that the chlorine fed into the gas phase would be combined in the sulfide bed and respectively the arsenic compounds of the gas phase would remain unchlorinated.

The value of the free energy obtained for the reaction $$3FeCl_2(l)+As_2S_3(l)\rightleftharpoons3FeS(s)+2AsCl_3(g)$$

$$\Delta G=-314.170T+85.677T\log T+57.296 \quad (18)$$

at 1000° K. is $\Delta G=+157$ cal, which would indicate the stability of ferrochloride. At the high partial pressure of sulfur of the sulfidization process, iron sulfide contains less metal, in which case the activity of the iron sulfide which corresponds to the reaction is lowered. At 1000° K. the pyrrhotite compositions and the activity values of iron sulfide are as follows:

$$P_{S2}=1.0\text{ atm, }Fe_{1-\delta}S+FeO_{0.838}S,\ a_{FeS}=0.445$$

$$P_{S2}=0.1\text{ atm, }Fe_{1-\delta}S=Fe_{0.852}S,\ a_{FeS}=0.515$$

Equation (18) yields the following arsenic chloride pressures corresponding to these compositions: $P_{AsCl3}$, atm: 3.19 atm ($P_{S2}=1$) and 2.60 atm ($P_{S2}=0.1$). Thus, iron sulfide is not chlorinated under the conditions of the process even if it is present in excess in relation to the quantity dissolved by copper minerals.

The selectivity of the chlorination of arsenic is far more advantageous for digenite than for pyrrhotite.

$$6CuCl(l)+As_2S_3(l)\rightleftharpoons2AsCl_3(g)+3Cu_2S$$

$$\log k=-20209/T-51707\log T+182.634 \quad (19)$$

At 1000° K., the following values are thus obtained for the reaction:

$$\Delta G=-33401,\ k=2.014\times10^7$$

$$P_{S2}=0.84;\ Cu_{1.792}S,\ A_{Cu2S}=0.695,\ P_{AsCl3}=6.0\times10^7\text{ atm.}$$

As observed above, the melting points and melting compositions of the enargites of arsenic and antimony as well as the respective proportions of these minerals and digenite at an elevated sulfur pressure are unknown. On the basis of certain systems which have been studied it can be assumed that an increase in the copper insufficiency in chalcocite tends to increase the temperatures of the melting ranges of the systems (e.g. the $Cu_{2-\delta}PbS$ system: on the binary solidification line in section $Cu_2S-PbS-Cu_{1.80}S$ the maximum is at 570° C.; eutectics, δ/T°C.: 0.00/525°, 0.10/550° and 0.20/565°).

The presence of iron in the system under discussion has an advantageous influence in preventing the problems arising in the melt phase ranges. The corresponding phase diagrams are not, however, known. Iron dissolves in the lattice of the original fahlerz at the ratio Cu/Fe=5, i.e. as a sulfide the product corresponds to bornite. The dissociation of enargite then corresponds to reaction $$5Cu_3AsS_4+3FeS \rightleftarrows 3Cu_5FeS_4+2\tfrac{1}{2}As_2S_3(l)+1\tfrac{3}{4}S_2(g)$$

$$\Delta G=24785+301.254T-113.480T\log T \quad (20)$$

The value obtained for the free energy of Reaction (20) at 1000° K. per one mole of $As_2S_3$ is $\Delta G=-5760$. The corresponding value for iron-free enargite [Equation (9)] is $\Delta G=+6065$. Thus, in the presence of iron the equilibrium of the reaction shifts towards one which is more advantageous for the processing.

If the iron quantity is higher than above, the copper of enargite combines to form chalcopyrite $$2Cu_3AsS_4+6FeS+\tfrac{1}{2}S_2 \rightarrow 6CuFeS_2+As_2S_3(l)$$

$$\Delta G=-139781-233.717T\log T+818.330T \quad (21)$$

The free energy of the reaction (1000° K.) is thus $\Delta G=-22602$, i.e. the process is even more advantageous than above. The combining of iron into copper minerals also totally inhibits its halogenation during the halogenation of the gas phase (FIG. 2).

Fahlerz and the accompanying minerals which structurally belong to them often contain, in addition to the conventional iron, zinc and tin, large quantities of rare heavy metals. Some examples are: Ga (>2% by weight), In, Te, Ge (8–10% by weight), Cd, Hg (>17% by weight). Often a considerable part of the sulfur in the minerals has been replaced by selenium and tellurium (Te>17% by weight). During the structural-change sulfidization of the minerals these metals often form very stable sulfides, which, however, usually have a considerably high vapor pressure.

Germanium forms very stable sulfide compounds which, within the operating range of the process, appear as solids or melts: $GeS_2(s)$, $GeSe_2(s,l)$ and GeTe(s,l). These compounds pass into the gas phase through dissociation or direct vaporization:

$$GeS_2(s) \rightleftarrows GeSe(g)+\tfrac{1}{2}S_2$$

$$\log(P/atm)=-8566.7/T+7.382 \quad (22)$$

$$GeSe_2(s) \rightleftarrows GeSe(g)+\tfrac{1}{2}Se_2(g)$$

$$\log(P/atm)=-9697.0/T-0.363\log T+9.715 \quad (23)$$

$$GeTe(s) \rightleftarrows GeTe(g)$$

$$\log(P/atm)=-10420/T+8.516 \quad (24)$$

At 1000° K. the dissociation pressures are P mmHg: 57.9/$GeS_2$, 64.4/$FeSe_2$ and 9.48/GeTe. Thus the dissociation pressures are not very high. Depending on the proportions of sulfur, selenium and tellurium, the vaporization can occur from sulfides formed by conversion, which is very advantageous regarding tellurides, for example. The compounds which have passed into the gas phase are halogenated in the gas phase, in which case the vaporization continues effectively in spite of low vapor pressures. The reactions in the gas-phase halogenation are as follows:

$$\tfrac{1}{2}GeS(g)+S_2Cl_2(g) \rightleftarrows \tfrac{1}{2}GeCl_4(g)+5/4S_2(g)$$

$$\Delta G=-7.528T+1.165T\log T-29190 \quad (25)$$

$$2/5GeSe(g)+S_2Cl_2(g) \rightleftarrows 2/5GeCl_4(g)+1/5Se_2Cl_2(g)+S_2(g)$$

$$\Delta G=-6.137T+0.886T\log T-24384 \quad (26)$$

$$\tfrac{1}{3}GeTe(g)+S_2Cl_2(g) \rightleftarrows \tfrac{1}{3}GeCl_4(g)+\tfrac{1}{3}TeCl_2(g)+S_2(g)$$

$$\Delta G=-32.743T+3.906T\log T-11552 \quad (27)$$

At 1000° K. the values of free energy are respectively: −33224, −27862 and −32577 cal, and so the reactions occur effectively.

The very stable sulfide of indium, corresponding to a high sulfur pressure, dissociates according to the following equation:

$$In_2S_3(s) \rightleftarrows In_2S(g)+S_2(g)$$

$$\log(P/atm)=-11180/T+6.37 \quad (28)$$

Even though the vapor pressure of the monosulfide of indium is very low (1100° K., $P=8.04\times10^{-5}$ atm) in the sulfidization system, quite considerable quantities of indium can be vaporized with the aid of halogen conversion. The chloride conversion corresponds to equation $$In_2S(g)+S_2Cl_2(g) \rightleftarrows 2InCl(g)+1\tfrac{1}{2}S_2(g)$$

$$\Delta G=-81506+8.221T\log T-8.835T$$

$$(1000°\ K.,\ \Delta G=-65678\ cal) \quad (29)$$

The mercury is vaporized from the sulfide system as a metal vapor (HgS is not stable). When the gas phase is halogenated the conversion to halides can be achieved under all conditions of the process.

During the sulfidization of the concentrate the selenium and tellurium pass into the gas phase either as such or in the form of various compounds. In the halogenation of the gas phase they are converted to respective selenium and tellurium halides. In the form of halides, even at low concentrations, these components can easily be separated from sulfur vapor. The chlorination reactions corresponding to selenium and tellurium are:

$$Se_2(g)+S_2Cl_2(g)Se_2Cl_2(g)+S_2(g)$$

$$\Delta G = -11{,}502T + 3{,}024T + 3{,}024T \log T - 2938 \quad (30)$$

$$\tfrac{1}{2}Te_2(g) + S_2Cl_2(g) \rightleftarrows TeCl_2(g) + S_2(g)$$

$$\Delta G = -33{,}057T + 4.699T \log T - 10366 \quad (31)$$

At 1000° K. the values of free energy are respectively $\Delta G = -5368$ and $\Delta G = -29326$ cal. The value of free energy obtained for monoatomic tellurium gas is $\Delta G = -48188$ cal.

From the curves of free energy in FIG. 2 it can be observed that the stability of the impurity chlorides as regards $S_2Cl_2$ disappears when the temperature of the system lowers. In this case the impurities (e.g. As, Sb, Bi) would become reconverted to sulfides and would, together with sulfur vapor, form a very viscous polymer when the vapor liquefies. This, however, does not occur. The reference state in FIG. 2 is a diatomic sulfur molecule, which is no longer valid at a lowered temperature, since the atomic number of the sulfur molecules increases within 2–8. The reference state thus becomes variable, a function of both the pressure and the temperature. The $Sb_2S_3$-$S_2Cl_2$/$SbCl_3$ equilibrium at a sulfur pressure of one atmosphere is discussed as an example by comparing it with $S_2$ vapor.

The value of free energy corresponding to reaction $$Sb_2S_3(1,g) + 3S_2Cl_2(g) \rightleftarrows 2SbCl_3(g) + (9/v)Sv(g) \quad (32)$$

is in this case $$\begin{aligned}\Delta G &= (9/v)G_{Sv} + 2G_{SbCl3} - 3G_{S2Cl2} - G_{Sb2S3} \\ &= (9/v)G_{Sv} - 79833 + 136.897\,T \log T - 277.170\,T\end{aligned}$$

The free molar energy of sulfur vapor must be determined on the basis of the equilibrium constants (Kv) determining the gas composition (Sv), molar proportion (Nv) and the values of free energy (Gv) of sulfur molecules (Sv). The values of the equilibrium constants of the gas components and the free molar energies of the components of sulfur vapor (Sv) are indicated in Tables 8 and 9.

The equations determining the gas phase equilibrium are thus $$\Sigma_v P_{S2}^{v/2} Kv = 1, v = 2\text{–}8$$

$$Kv = \exp[A/T + B \ln T + C]$$

$$G_v = H_v + T_{Sv}$$

$$G_{Sv} = (2/v)[\Sigma_v N_v G_v]$$

$$G_v = aT + bT\ 1N\ T + cT^2 + d/T + e \quad (33)$$

Figure 4:
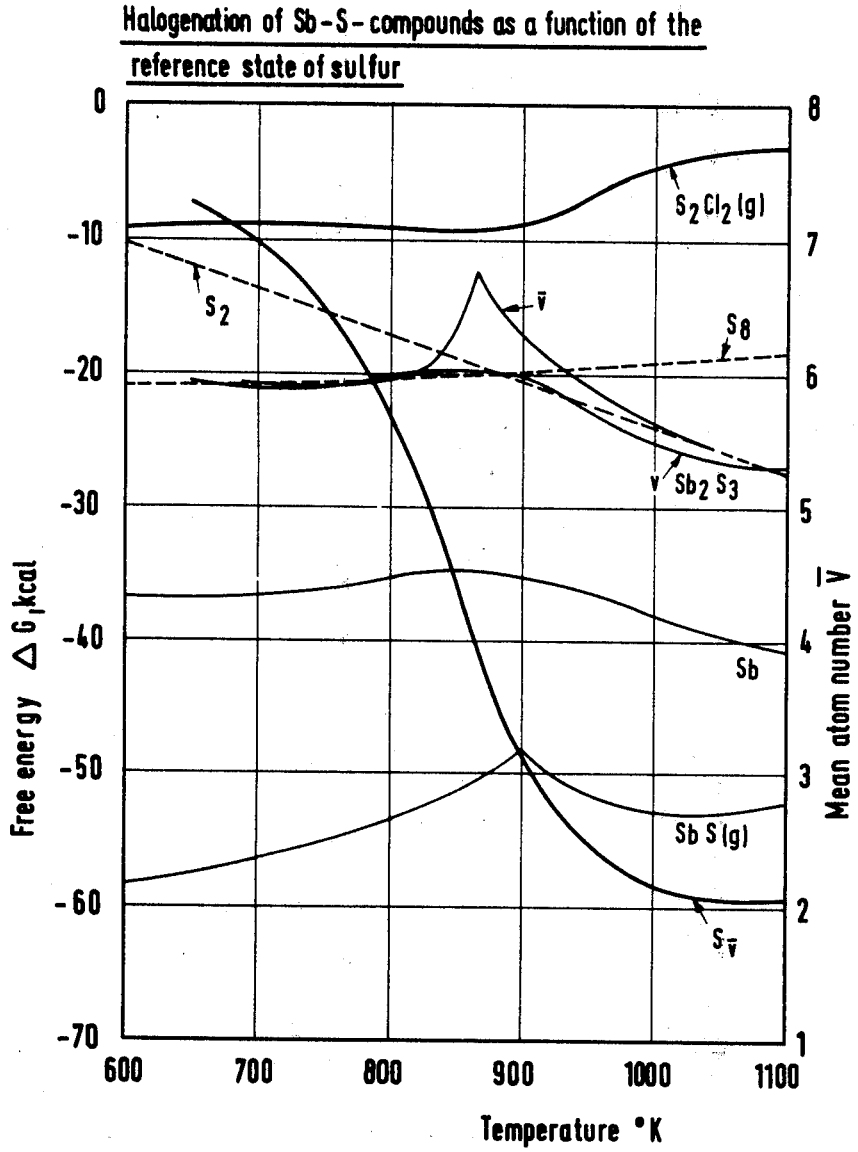
FIG. 4 is a diagram showing the halogenation of Sb-S compounds as a function of the reference state of sulfur.

The values of free energy, per one mole of $S_2Cl_2$, of the chloride equilibriums corresponding to the components $Sb_2S_3$, SbS and Sb of the S-Sb vaporization system and the $S_2Cl_2$ equilibrium have been calculated according to these equations and are shown in FIG. 4. The figure also shows the average atomic numbers (v) of the sulfur vapor molecules, corresponding to the change in temperature. In addition to the equilibriums corresponding to the real atomic number (v) of the sulfur molecule, the diagram corresponding to the equilibriums $Sb_2S_3$/$SbCl_3$ in the figure also shows the equilibriums corresponding to the average atomic number (v) of the molecule. The latter method does not yield a correct result, owing to the mutual irregular change in the atomic number as a function of the temperature of the Sv components. It can be observed from FIG. 4 that the chlorides corresponding to the Sb-S system are stable as regards sulfur chloride even at low temperatures. The same can also be shown concerning the chlorides of other impurity components.

The stabilities of the impurity chlorides have a great importance in the carrying out of the process according to the invention, for the following reasons, among others:

A highly viscous polymer of sulfur is not formed when the gas phase cools, and so the elemental sulfur obtained from the conversion system is as such ready to be used in the sulfidization to be carried out as a cycled process. Furthermore, outlet pipes for the polymer, operating at a high temperature, are not necessary in the conversion system. The amount of heat obtained in the polymerization of pure sulfur vapor, as well as the excess (released during the process) amount of sulfur can be recovered in a conventional sulfur boiler (an easily flowing sulfur melt).

In gaseous state the impurity chlorides are easy to separate from the solidifying sulfur and be recovered as condensing chlorides for further refining.

Some of the mineral combinations within the scope of the process are endothermal as regards the total process. This is usually due to the fact that during the sulfidization reactions not only impurity sulfides but also a large amount of sulfur is separated from the minerals and passes into the gas phase, and the heat of vaporization of this sulfur at the process temperature is so high that it makes the process endothermal. Usually structural sulfidization combines sulfur of the feed and thereby often results in a strongly exothermal sulfidization process.

Indirect external heating is not used when the process according to the invention is implemented on the industrial scale. Owing to the pulverous concentrate, the low gas-phase quantity and the low gas flow rate, the system has a low transfer of heat, especially in indirect heating. Introducing the required heat into the system internally, for example, by using fossil fuel, leads to great losses of sulfur ($H_2S$, CS, $CS_2$, COS, etc.) and simultaneously to low partial pressures of sulfur, which are kinetically disadvantageous for the process. Also, fossil fuel burns so rapidly that local increases in temperature (complex concentrates have a low melting range), disadvantageous for the process, are created in the system. Usually the introduction of the small amounts of heat required is carried out best by burning part of the sulfur fed into the system or part of the sulfur produced in the reactions. Owing to the poor heat transfer properties of sulfur, a narrow, long flame is produced in the burning of sulfur, in which case the amount of heat is distributed evenly over the reaction zone. Furthermore, the flame is cold since the combustion value of sulfur is low compared with fossil fuel. It should be noted in particular that the halide conversion of the gas phase is always strongly exothermal, and therefore the additional heat requirement remains low. However, when sulfur is burned, the possible reactions of sulfur dioxide as regards both the sulfides and the halides of the gas phase must be taken into consideration.

In experimental studies of the question, at the lower limit of the operating range as regards the sulfur pressure ($P_{S2} = 0.2$ atm), sulfur dioxide did not yet show any influence on the sulfides or halides of the gas phase.

The reactions of the most important impurity compounds with sulfur dioxide are as follows:

$$Sb_2S_3(l)+1\tfrac{1}{2}SO_2(g)\rightleftarrows Sb_2O_3(l)+2\tfrac{1}{4}S_2(g)$$

$$\Delta G=59256+5.835T\log T-44.199T$$

$$(1000^\circ\text{ K.},\ \Delta G=+32562\text{ cal}) \quad (34)$$

$$2SbCl_3(g)+1\tfrac{1}{2}SO_2(g)+2\tfrac{1}{4}S_2(g)\rightleftarrows Sb_2O_3(l)+3S_2Cl_2(g)$$

$$\Delta G=12931-41.044T\log T+214.949T$$

$$(1000^\circ\text{ K.},\ \Delta G=+104748\text{ cal}) \quad (35)$$

$$As_2S_3(g)+1\tfrac{1}{2}SO_2(g)\rightleftarrows\tfrac{1}{2}As_4O_6(g)+2\tfrac{1}{4}S_2(g)$$

$$\Delta G=45384+55.909T\log T-195.976T$$

$$(1000^\circ\text{ K.},\ \Delta G=17135\text{ cal}) \quad (36)$$

$$2AsCl_3(g)+1\tfrac{1}{2}SO_2+2\tfrac{1}{4}S_2(g)\rightleftarrows\tfrac{1}{2}As_4O_6(g)+3S_2Cl_2(g)$$

$$\Delta G=16297-4{,}568T\log T+87874T$$

$$(1000^\circ\text{ K.},\ \Delta G=90467\text{ cal}) \quad (37)$$

$$Bi_2S_3(l)+1\tfrac{1}{2}SO_2(g)\rightleftarrows Bi_2O_3(l)+2\tfrac{1}{4}S_2(g)$$

$$\Delta G=80280+11.017T\log T-58.899\ T$$

$$(1000^\circ\text{ K.},\ \Delta G=54432\text{ cal}) \quad (38)$$

$$2BiCl_3(g)+1\tfrac{1}{2}SO_2(g)+2\tfrac{1}{4}S_2(g)\rightleftarrows Bi_2O_3(l)+3S_2Cl_2(g)$$

$$\Delta G=12336-22.979T\log T+179.845T$$

$$(1000^\circ\text{ K.},\ \Delta G=123244\text{ cal}) \quad (39)$$

$$\tfrac{1}{2}Se_2(g)+SO_2(g)\rightleftarrows SeO_2(g)+\tfrac{1}{2}S_2(g)$$

$$\Delta G=44015-1.775T$$

$$(1000^\circ\text{ K.},\ \Delta G=42440\text{ cal}) \quad (40)$$

$$Se_2Cl_2(g)+2SO_2(g)\rightleftarrows 2SeO_2(g)+S_2Cl_2(g)$$

$$\Delta G=92154-2.305T$$

$$(1000^\circ\text{ K.},\ \Delta G=89849\text{ cal}) \quad (41)$$

$$\tfrac{1}{2}Te_2(g)+SO_2(g)\rightleftarrows TeO_2(s)+\tfrac{1}{2}S_2(g)$$

$$\Delta G+-6740+39.475T$$

$$(1000^\circ\text{ K.},\ \Delta G=32375\text{ cal}) \quad (42)$$

$$TeCl_2(g)+SO_2(g)+\tfrac{1}{2}S_2(g)\rightleftarrows TeO_2(s)+S_2Cl_2(g)$$

$$\Delta G+5438+56.625T$$

$$(1000^\circ\text{ K.},\ \Delta G=62063\text{ cal}) \quad (43)$$

Thus it can also be observed from the values of the free energies of the reactions that the presence of oxygen in the form of sulfur dioxide cannot reverse the reactions towards an oxidizing direction within the operating range of the process, but the direction is the opposite. It has been shown experimentally that the process according to the invention is suitable for the treatment of the impurity-bearing oxidic, sulfidic and sulfatized fly dusts of smelting plants. When oxidic fly dusts are treated, the retention time has proven to be longer than in a conventional process. The combined feeding of sulfidic complex concentrate and fly dusts into the process has proven to be very advantageous, especially when elemental sulfur is released from the sulfidic concentrate during the process. Since the sulfidization of oxides is usually endothermal, the respective amount of heat can be obtained in part from the increased halogen requirement and the related exothermal reactions.

It can be noted that in general, in order to obtain additional heat, sulfur can be burned freely in the conversion system so that during the sulfidization-halogenation process the partial pressure of sulfur remains at the value required by the sulfidization kinetics.

Figure 5:
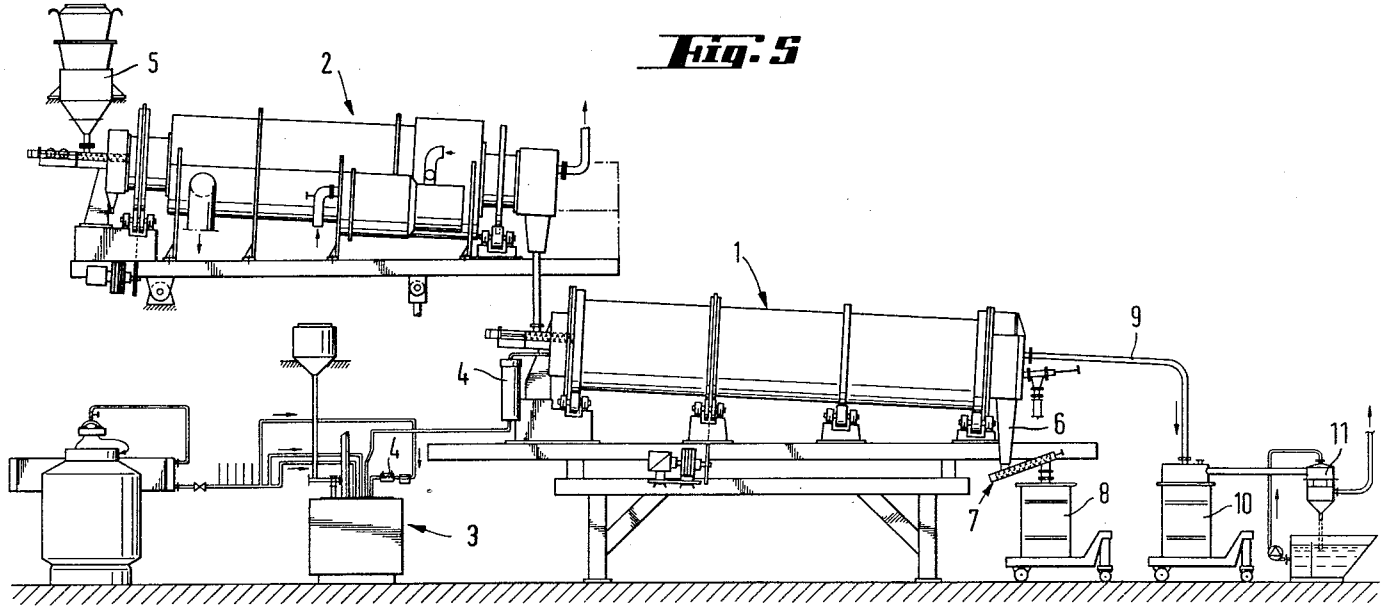
FIG. 5 shows a conversion apparatus used in accordance with the invention.

The pilot conversion apparatus used in the experiments is shown in FIG. 5. The apparatus consisted of two indirectly heated drum furnaces 1 and 2, a sulfur vaporizer 3, a preheating system 4 for the gases, feeding and withdrawing devices 5 and 6 for concentrate, sulfur, halogen and halides. The hermetically closed apparatus was fully automated.

Each drum furnace 1 and 2 comprised fixed lining and a noble-steel drum rotating inside it (diameter 0.6 m, length 6.0 m). Both the inclination and the rotational velocity of the drum were regulatable in each furnace. The topmost, gas-heated drum 2 according to FIG. 5 was used for the preheating of the concentrate. The other drum furnace 1, used as the actual processing device, was electrically heated. The processing was carried out concurrently in accordance with the figure. The preheated concentrate, sulfur and halogenization vapors were fed, each through its own feeding route, into the process drum 1. The product concentrate was discharged, through a cooling apparatus 7, into containers 8. The process gas phase 9 was directed, through a sulfur condensation apparatus 10, into a water scrubber 11, where the halide vapors were absorbed into the solution.

In the conversion experiments the pilot apparatus was operated at a capacity of approximately 50–150 kg/h.

The invention is described below in more detail with the aid of examples.

EXAMPLES

The trial runs described in the examples were performed using an enargite-bearing fahlerz-type concentrate. The arsenic, antimony and bismuth present were replaceable by each other, and thus independent, pure arsenic and antimony minerals were not present in the concentrate. The zinc, part of the iron, the mercury, etc., were combined, besides copper and silver, in arsenic-antimony-bismuth minerals. The independent minerals appearing in the concentrate were lead as a sulfide and part of the iron as a pyrite-pyrrhotite mixture.

The symbol Me in the analyses in Table 1 stands for the metals present in low concentrations in the concentrate: Sn, Cd, Ni, Co, Mn. The anaylzed composition of the oxide phase of the concentrate (% by weight) is: 2.30 $SiO_2$, 0.22 CaO, 0.03 MgO, 0.10 $TiO_2$, and 0.57 $Al_2O_3$.

Nitrogen was used as the carrier gas for sulfur vapor. In some experiments, part of the sulfur was burned, partly in order to measure the oxygen tolerance of the system and partly in order to realize the thermal balance of the process (in the case of the concentrate used the sulfidization process was slightly endothermal). In order to maintain the high partial pressure of sulfur vapor in the processing gas phase, air containing oxygen 50% by weight was used for burning the sulfur. At a feeding temperature of 725° C. the partial pressure of the sulfur vapor was (the average atomic number of the molecules corresponded to approx. 2.4) $P_{S2}=0.8$ atm and during the processing its partial pressure was not allowed to fall under $P_{S2}=0.2$ atm.

Both halogens and at times air were fed to a distance of approx. 2 m from the feeding end of the processing drum 1 (i.e., past the zone of beginning sulfidization of the concentrate).

EXAMPLE 1

In the case according to the example, a conventional structural-change sulfidization was performed on the concentrate, whereby a mixture of bornite and chalcopyrite was obtained as the product sulfide. Antimony (0.21% by weight Sb) and bismuth (0.02% Bi) were still present in the product sulfide. Arsenic, mercury, selenium and tellurium had vaporized quantitatively.

When the sulfide components of the gas phase are calculated as monomers, the partial pressure of sulfur obtained for the gas phase emerging from the system is $P_{S2}=0.22$ atm (which is in this case the minimum). Of course, the partial pressure of sulfur can be elevated, when necessary, by increasing the quantity of sulfur fed into the system.

The feed analysis corresponding to Example 1 is shown in Table 1, and the material and heat balances are shown in Table 2.

EXAMPLE 2

In the case according to Example 2 the sulfidization of the concentrate was carried out in the conventional manner, but the vaporized impurity sulfides of the gas phase were converted to halides by means of chlorine. As a result of the conversion both the antimony and the bismuth vaporized from the products quantitively. In the concentrate under discussion the quantities of antimony and bismuth, as well as selenium and tellurium, were relatively low. However, quite large quantities of antimony (several percent in the concentrate) and other said components were vaporized by the process (e.g. Se: 5% by weight), and so the applicability of the process is not limited to the amounts of material present in the example concentrate (natural concentrate).

In the case corresponding to Example 2, the sulfur content (elemental sulfur) in the gas phase increased strongly (53% of the amount fed) as a result of the conversion. The partial pressure of sulfur in the product gas phase was (when the chlorides were calculated as monomers) $P_{S2}=0.34$ atm (minimum). The following balance is obtained as the thermal balance for the sulfide-chloride conversion of the gas phase:

In: sulfide: 198.381 kg+chlorine: 168.360 kg $$\Delta H_{3+f}=54.402\times10^{-3}T+1.533\times10^{-6}T-20.156$$

Out: chlorides: 290.540 kg+sulfur: 76.201 kg $$\Delta H_{e+f}=41.505\times10^{-3}T-79.384$$

Calculated for a constant temperature of 1000° K., chlorination thus produces, as a balance difference, 75.658 Mcal of additional heat for the system. Thus, in addition to its other advantages, conversion very strongly improves the heat economy of the process.

EXAMPLE 3

In the case corresponding to Example 3, so much iron in the form of pyrrhotite was added to the feed concentrate that the structure of the product concentrate corresponded to that of chalcopyrite. In other respects Example 3 corresponds to Example 2.

In the description of the process above, the advantageous effect of the iron addition on both reaction equilibriums and the prevention of detrimental melt phases was pointed out. Furthermore, by creating the stable chalcopyrite the iron addition also has an advantageous effect on the thermal balance of the process. This can be observed from the following balance:

In: Product concentrate (1): 723.622 kg+pyrrhotite: 204.750 kg+sulfur: 37.340 kg→Σ965.752 kg Out: Product concentrate (2): 965.752 kg $$\Delta H_{e+f}=208.528\times10^{-3}T-310.312$$

At a constant temperature of 1000° K., the chalcopyrite formation thus produces 32.270 Mcal of additional heat as a balance difference.

The feed and product analyses corresponding to Examples 2 and 3 are shown in Table 1 (indicated respectively by indices (1) and (2)), and the material and heat balances are shown in Tables 3 and 4.

EXAMPLE 4

In the case corresponding to Example 4 the impurity components of the sulfidization gas phase were converted to fluorides. Fluorine compounds behave analogously to chlorine compounds under the conditions of the new process. The use of fluorine compounds is, however, necessary in only a few special cases.

The fluorides of the impurity metals are highly stable compounds, and so the energy released in the conversion is a very useful source of additional heat in cases where the sulfidization process is very endothermal.

In Example 4 under discussion, easily treatable hexafluoride of sulfur ($SF_6(g)$) was used for the fluorination. In this case the additional heat obtained for the system in the conversion was not considerable, since hexafluoride is very stable.

The additional amount of heat obtained in hexafluoride conversion corresponds to the following balance calculation:

In: sulfide: 198.381 kg+hexafluoride: 116.678 kg $$\Delta H_{e+f}=62.138\times10^{-3}T+1.533\times10^{-6}T^2-256.804$$

Out: fluorides: 213.243 kg+sulfur: 101.816 kg $$\Delta H_{e+f}=44.817\times10^{-3}T-315.011$$

The additional amount of heat obtained at a temperature of 1000° K. is 77.061 Mcal.

When the halogenation is carried out using fluorine gas, the thermal balance of the conversion is:

In: sulfide: 198.381 kg+fluorine: 91.063 kg $$\Delta H_{3+f}=54.293\times10^{-3}T+T+1.533\times10^{-6}T^2-20.411$$

Out: fluorides: 213.243 kg+sulfur: 76.201 kg $$\Delta H_{e+f}=41.314\times10^{-}T-326.181$$

At a constant temperature of 1000° K., a large amount of heat, i.e. 320.282 Mcal, is released in the conversion when fluorine gas is used. The analysis and balance values corresponding to Example 4 are given in Tables 1 and 5.

EXAMPLE 5

In a case corresponding to Example 5, fluorination according to Example 4 is carried out so that, in addition to hexafluoride, elemental fluorine gas is used in such a quantity that the thermal balance of the system is realized, corresponding to the comparison calculation performed in Example 4. From the material and thermal balance in Table 6, corresponding to the example, it can be observed that the thermal balance of the system is realized even with a small addition of fluorine, and thus the burning of sulfur is unnecessary. Thus, during the processing the partial pressure of sulfur is high, $P_{S2}=0.65$ atm (in Example 4: $P_{S2}=0.35$ atm), which is useful especially when processing iron-poor concentrates (digenite remains stable).

The above thermal balance effect in the system is, of course, also achieved by using fluorochlorination. In this case the less reactive halogenating agent is easy to handle, but the refining of the mixed halides is a multistage process. In this case compounds between halogens (ClF(g), $ClF_3$(g), etc.), chlorinated fluorides of sulfur (several different compounds) or the mixtures mentioned above can be used for halogenation.

EXAMPLE 6

In the case according to Example 6, fly dust was fed into the system at 10% of the quantity of fahlerz concentrate. In other respects it corresponded to Example 2.

The feed fly dust was partly sulfatized and contained mainly oxidic impurities combined in oxides of arsenic, antimony and bismuth and partly mixed with each other (Pb smelting plant dust). The analysis of the fly dust (% by weight) was as follows: 10.44 Cu, 7.33 Zn, 2.45 Pb, 15.50 Fe, 5.56 As, 1.22 Sb, 0.67 Bi, 0.31 Se, 0.11 Cd, 0.16 Ag, 0.56 Sn, 5.24 S, 15.44 O, 91 ppm Re, 69 ppm Ge, 5 ppm In, 670 ppm Hg, 667 ppm Mo, 20.0 $SiO_2$, 4.8 CaO, 1.1 MgO and 4.3 $Al_2O_3$.

The impurity metals of the system vaporized quantitatively. The analysis of the product chloride (% by weight) was as follows: 38.75 As, 2.50 Sb, 0.38 Bi, 0.19 Se, 0.26 Te, 0.11 Sn, 476 ppm Hg, 400 ppm Cd, 30 ppm Re, 22 ppm Ge and 2 ppm In.

The material and thermal balances corresponding to Example 6 are given in Table 7. In the case corresponding to the example the processing of the fly dust does not alter the conditions of the system to a noteworthy degree. This is mainly due to the fact that the fahlerz concentrate used yielded, in a direct contact with the oxides, the sulfur required for the sulfidization of the fly dust. The thermal balance of the process was very advantageous since the quantity of sulfur to be vaporized remained lower than in the case corresponding to Example 2.

TABLE 1

Analyses of the feed and product components of the examples

| Balance component | | | Balance analyses, % by weight | | | | | | | |
|---|---|---|---|---|---|---|---|---|---|---|
| | | | A<br>B | Cu<br>As | Fe<br>Sb | Zn<br>Bi | Pb<br>Se | Me<br>Te | Ag<br>Hg | Au<br>S | Ox<br>Cl/F |
| Concentrate | (1) | A | 30.50 | 13.80 | 0.82 | 0.28 | 0.08 | 0.041 | 0.015 | 3.22 |
| | | B | 11.40 | 0.65 | 0.05 | 0.03 | 0.08 | 0.008 | 35.50 | — |
| Concentrate mixture | (2) | A | 25.32 | 22.25 | 0.68 | 0.23 | 0.07 | 0.034 | 0.013 | 2.67 |
| | | B | 9.46 | 0.51 | 0.04 | 0.03 | 0.07 | 0.007 | 35.67 | — |
| Product concentrate | (1) | A | 42.15 | 19.07 | 1.13 | 0.39 | 0.12 | 0.057 | 0.021 | 4.45 |
| | | B | — | — | — | — | — | — | 27.75 | — |
| Product concentrate | (2) | A | 31.58 | 27.76 | 0.85 | 0.29 | 0.09 | 0.042 | 0.016 | 3.33 |
| | | B | — | — | — | — | — | — | 32.40 | — |
| Product polymer sulfide fraction | (1) | B | 37.32 | 2.13 | 0.16 | 0.10 | 0.26 | 0.03 | 60.00 | — |
| | | B | 57.47 | 3.28 | 0.25 | 0.15 | 0.40 | 0.04 | 38.41 | — |
| Vaporization chloride | | B | 39.13 | 2.23 | 0.17 | 0.10 | 0.27 | 0.03 | 0.13 | 57.93 |
| Vaporization fluoride | | B | 53.02 | 3.02 | 0.23 | 0.14 | 0.37 | 0.04 | 0.18 | 43.00 |

TABLE 2

Conventional structural-change sulfidization

| Balance component | Temperature; amounts of material and heat | | |
|---|---|---|---|
| | T, °K. | M, kg | $\Delta H_{e+f}$, Mcal |
| Into the system | | | |
| Concentrate | 773 | 1000.00 | $138.261 \times 10^{-3}T_R - 219.678$ |
| Sulfur | 1000 | 83.69 | $11.445 \times 10^{-3}T + 36.497$ |
| Nitrogen | 1000 | 9.14 | $2.475 \times 10^{-3}T - 0.799$ |
| Air | 1000 | 145.45 | $36.129 \times 10^{-3}T - 10.892$ |
| In total | | 1238.29 | $138.261 \times 10^{-3}T_R + 50.049 \times 10^{-3}T - 194.872$<br>$\Delta H_{e+f} = -37.947$ Mcal |
| Out of the system | | | |
| Product concentrate | 1000 | 725.97 | $135.625 \times 10^{-3}T - 196.703$ |
| Vaporization sulfide | 1000 | 196.07 | $33.299 \times 10^{-3}T + 1.533 \times 10^{-6}T^2 - 13.514$ |
| Sulfur | 1000 | 107.07 | $14.643 \times 10^{-3}T + 46.691$ |
| Sulfur dioxide | 1000 | 109.06 | $23.958 \times 10^{-3}T - 131.493$ |
| Nitrogen, argon, etc. | 1000 | 100.12 | $25.848 \times 10^{-3}T - 7.833$ |

TABLE 2-continued

| Balance component | Conventional structural-change sulfidization: Temperature; amounts of material and heat | | |
|---|---|---|---|
| | T, °K. | M, kg | $\Delta H_{e+f}$, Mcal |
| Thermal losses | | | + 30.000 |
| Out total | | 1238.29 | $233.373 \times 10^{-3}T + 1.533 \times 10^{-6}T^2 - 272.852$ |
| | | | $\Delta H_{e+f} = -37.947$ Mcal |

TABLE 3

| Balance component | Structural sulfidization and gas-phase chlorination: Temperature: amounts of material and heat | | |
|---|---|---|---|
| | T, °K. | M, kg | $\Delta H_{e+f}$, Mcal |
| Into the system | | | |
| Concentrate | 773 | 1000.00 | $138.261 \times 10^{-3}T - 219.678$ |
| Sulfur | 1000 | 29.11 | $3.891 \times 10^{-3}T + 12.695$ |
| Nitrogen | 1000 | 3.18 | $0.861 \times 10^{-3}T - 0.278$ |
| Chlorine | 1000 | 168.36 | $20.840 \times 10^{-3}T - 6.456$ |
| Air | 1000 | 86.57 | $18.111 \times 10^{-3}T - 5.460$ |
| In total | | 1287.22 | $138.261 \times 10^{-3}T_R + 43.793 \times 10^{-3}T - 219.177$ |
| | | | $\Delta H_{e+f} = -68.508$ Mcal |
| Out of the system | | | |
| Product concentrate | 1000 | 723.66 | $135.362 \times 10^{-3}T - 196.517$ |
| Vaporization chloride | 1000 | 290.54 | $31.084 \times 10^{-3}T - 112.614$ |
| Sulfur | 1000 | 155.91 | $21.322 \times 10^{-3}T - 67.989$ |
| Sulfur dioxide | 1000 | 54.67 | $12.010 \times 10^{-3}T - 65.918$ |
| Nitrogen, argon, etc. | 1000 | 62.44 | $12.578 \times 10^{-3}T - 3.804$ |
| Thermal losses | | | 30.000 |
| Out total | | 1287.22 | $212.356 \times 10^{-3}T - 280.864$ |
| | | | $\Delta H_{e+f} = -68.508$ Mcal |

TABLE 4

| Balance component | Structural sulfidization to chalcopyrite and gas-phase chlorination: Temperature: amounts of material and heat | | |
|---|---|---|---|
| | T, °K. | M, kg | $\Delta H_{e+f}$, Mcal |
| Into the system | | | |
| Concentrate mixture | 773 | 1204.75 | $171.388 \times 10^{-3}T - 282.554$ |
| Sulfur | 1000 | 29.11 | $3.981 \times 10^{-3}T + 12.695$ |
| Nitrogen | 1000 | 3.18 | $0.861 \times 10^{-3}T - 0.278$ |
| Chlorine | 1000 | 168.36 | $20.840 \times 10^{-3}T - 6.456$ |
| Air | 1000 | 57.63 | $12.056 \times 10^{-3}T - 3.635$ |
| In total | | 1463.03 | $171.388 \times 10^{-3}T_R + 37.738 \times 10^{-3}T - 280.228$ |
| | | | $\Delta H_{e+f} = -110.007$ Mcal |
| Out of the system | | | |
| Product concentrate | 1000 | 965.75 | $208.528 \times 10^{-3}T - 310.312$ |
| Vaporization chloride | 1000 | 290.54 | $31.084 \times 10^{-3}T - 112.614$ |
| Sulfur | 1000 | 127.72 | $17.466 \times 10^{-3}T + 55.694$ |
| Sulfur dioxide | 1000 | 36.39 | $7.995 \times 10^{-3}T - 43.882$ |
| Nitrogen, argon, etc. | 1000 | 42.63 | $8.661 \times 10^{-3}T - 2.625$ |
| Thermal losses | | | |
| Out total | | 1463.03 | $273.734 \times 10^{-3}T - 383.739$ |
| | | | $\Delta H_{e+f} = -110.005$ Mcal |

TABLE 5

| Balance component | Structural sulfidization and gas-phase fluorination: Temperature: amounts of material and heat | | |
|---|---|---|---|
| | T, °K. | M, kg | $\Delta H_{e+f}$, Mcal |
| Into the system | | | |
| Concentrate | 773 | 1000.00 | $138.261 \times 10^{-3}T_R - 219.678$ |
| Sulfur | 1000 | 29.11 | $3.981 \times 10^{-3}T + 12.695$ |
| Nitrogen | 1000 | 3.18 | $0.861 \times 10^{-3}T - 0.278$ |
| Air | 1000 | 102.63 | $21.473 \times 10^{-3}T - 6.473$ |
| Hexafluoride | 400 | 116.68 | $28.576 \times 10^{-3}T_F - 243.104$ |
| In total | | 1251.60 | $138.261 \times 10^{-3}T_R + 26.315 \times 10^{-3}T + 28.576 \times 10^{-3}T_F$ |
| | | | $-456.838$, $\Delta H_{e+f} = -312.217$ Mcal |
| Out of the system | | | |
| Product concentrate | 1000 | 723.66 | $135.362 \times 10^{-3}T - 196.517$ |
| Vaporization fluoride | 1000 | 213.24 | $30.893 \times 10^{-3}T - 359.411$ |
| Sulfur | 1000 | 176.45 | $24.130 \times 10^{-3}T + 76.944$ |
| Sulfur dioxide | 1000 | 64.82 | $14.239 \times 10^{-3}T - 78.151$ |
| Nitrogen, argon, etc. | 1000 | 73.44 | $14.752 \times 10^{-3}T - 4.458$ |
| Thermal losses | | | 30.000 |
| Out total | | 1251.60 | $219.376 \times 10^{-3}T - 521.593$ |

TABLE 5-continued

| Balance component | Structural sulfidization and gas-phase fluorination<br>Temperature: amounts of material and heat<br>T, °K. | M, kg | $\Delta H_{e+f}$, Mcal |
|---|---|---|---|
| | | | $\Delta H_{e+f} = -312.217$ Mcal |

TABLE 6

| Balance component | | Structural sulfidization and gas-phase fluorination<br>Temperature: amounts of material and heat<br>T, °K. | M, kg | $\Delta H_{e+f}$, Mcal | |
|---|---|---|---|---|---|
| Into the system | | | | | |
| Concentrate | | 773 | 1000.00 | $138.261 \times 10^{-3}T - 219.678$ | |
| Sulfur | ($S_2$) | 1000 | 29.11 | $3.881 \times 10^{-3}T + 12.695$ | |
| Nitrogen | | 1000 | 3.18 | $0.861 \times 10^{-3}T - 0.278$ | |
| Hexafluoride | ($SF_6$) | 298 | 74.22 | $18.178 \times 10^{-3}T_F - 154.645$ | |
| Fluorine | ($F_2$) | 298 | 33.14 | | |
| In total | | | 1139.65 | $138.261 \times 10^{-3}T_R + 4.842 \times 10^{-3}T + 18.178 \times 10^{-3}T_F - 361.903$; $\Delta H_{e+f} = -244.771$ Mcal | |
| Out of the system | | | | | |
| Product concentrate | | 1000 | 723.66 | $135.362 \times 10^{-3}T - 196.517$ | |
| Vaporization fluoride | | 1000 | 213.24 | $30.893 \times 10^{-3}T - 359.411$ | |
| Sulfur | ($S_2$) | 1000 | 199.57 | $27.292 \times 10^{-3}T + 87.027$ | |
| Nitrogen | | 1000 | 3.18 | $0.861 \times 10^{-3}T - 0.278$ | |
| Thermal losses | | | | | 30.000 |
| Out total | | | 1139.65 | $194.408 \times 10^{-3}T - 439.179$<br>$\Delta H_{e+f} = -244.771$ Mcal | |

TABLE 7

| Balance component | Structural sulfidization of concentrate and fly dust and gas-phase chlorination<br>Temperature: amounts of material and heat<br>T, °K. | M, kg | $\Delta H_{e+f}$, Mcal | |
|---|---|---|---|---|
| Into the system | | | | |
| Concentrate | 773 | 1000.00 | $138.261 \times 10^{-3}T - 219.678$ | |
| Fly dust | 773 | 100.00 | $20.341 \times 10^{-3}T - 64.492$ | |
| Sulfur | 1000 | 29.11 | $3.981 \times 10^{-3}T + 12.695$ | |
| Nitrogen | 1000 | 3.18 | $0.861 \times 10^{-3}T - 0.278$ | |
| Air | 1000 | 77.11 | $16.133 \times 10^{-3}T - 4.864$ | |
| Chlorine | 1000 | 178.10 | $22.046 \times 10^{-3}T - 6.830$ | |
| In total | | 1387.51 | $158.602 \times 10^{-3}T_R + 43.021 \times 10^{-3}T - 283.447$<br>$\Delta H_{e+f} = -117.827$ Mcal | |
| Out of the system | | | | |
| Product concentrate | 1000 | 813.03 | $154.062 \times 10^{-3}T - 219.664$ | |
| Vaporization chloride | 1000 | 308.57 | $32.901 \times 10^{-3}T - 119.167$ | |
| Sulfur | 1000 | 130.34 | $17.824 \times 10^{-3}T + 56.837$ | |
| Sulfur dioxide | 1000 | 79.61 | $17.488 \times 10^{-3}T - 95.986$ | |
| Nitrogen, argon, etc. | 1000 | 55.97 | $11.298 \times 10^{-3}T - 3.419$ | |
| Thermal losses | | | | + 30.000 |
| Out total | | 1387.52 | $233.573 \times 10^{-3}T - 351.399$<br>$\Delta H_{e+f} = -117.826$ Mcal | |

TABLE 8

| Component | | G-values of impurities and their compounds $G_i = aT + bT\log T + c$, kcal/kmol<br>ΔT, °K. | a | −b | −c |
|---|---|---|---|---|---|
| $As_2S_3$ | (l) | 600–996 | 266.890 | 105.292 | 34637 |
| $As_2S_3$ | (g) | >996 | 246.207 | 105.292 | 14037 |
| $As_2S_2$ | (l) | 600–973 | 209.200 | 80.591 | 29559 |
| $As_2S_2$ | (g) | >973 | 6.040 | 40.124 | 50431 |
| $As_2Se_3$ | (l) | 650–800 | 262.620 | 107.531 | 33632 |
| AsSe | (g) | 600–1200 | −0.368 | 20.171 | −46824 |
| $As_2Te_3$ | (l) | 648–800 | 201.070 | 92.104 | 11673 |
| AsTe | (g) | 600–1200 | −1.690 | 20.397 | 52028 |
| As | (s) | 400–800 | 33.876 | 14.534 | 1930 |
| $As_4$ | (g) | 600–1000 | 52.024 | 44.789 | 31434 |
| $Sb_2S_3$ | (l) | 823–1100 | 218.640 | 92.060 | 53411 |
| SbS | (g) | 800–1100 | −57.500 | 3.102 | −59976 |
| $Sb_2Se_3$ | (l) | 888–1000 | 220.460 | 94.407 | 35571 |
| SbSe | (g) | 600–1200 | −0.343 | 20.826 | −47903 |
| $Sb_2Te$ | (l) | 892–1000 | 263.760 | 113.979 | 13493 |
| SbTe | (g) | 600–1200 | −2.990 | 20.510 | −45618 |
| Sb | (l) | >904 | 34.930 | 17.180 | −2000 |
| $Sb_2$ | (g) | 800–1200 | 3.430 | 19.835 | −28103 |

TABLE 8-continued

| Component | | G-values of impurities and their compounds $G_i = aT + bT\log T + c$, kcal/kmol<br>ΔT, °K. | a | −b | −c |
|---|---|---|---|---|---|
| $Bi_2S_3$ | (s) | 600–1000 | 190.930 | 80.785 | 49432 |
| BiS | (g) | 700–1000 | −4.170 | 19.835 | −39095 |
| Bi | (l) | 800–1200 | 33.570 | 17.580 | 31 |
| Bi | (g) | 800–1200 | −15.140 | 10.341 | −48467 |
| $Bi_2$ | (g) | 800–1200 | −5.910 | 20.455 | −49961 |
| $AsCl_3$ | (g) | 600–1100 | 53.625 | 45.065 | 70893 |
| $SbCl_3$ | (g) | 493–1000 | 52.380 | 45.248 | 81907 |
| $BiCl_3$ | (g) | >712 | 48.727 | 46.052 | 69108 |
| $AsF_3$ | (g) | >330 | 61.860 | 44.467 | 226651 |
| $SbF_3$ | (g) | >592 | 66.783 | 46.052 | 203880 |
| $BiF_3$ | (g) | >1200 | 58.455 | 45.465 | 174859 |
| $S_2Cl_2$ | (g) | 600–1100 | 54.430 | 45.111 | 10190 |
| $Se_2Cl_2$ | (g) | 646–1000 | 47.635 | 45.338 | 11181 |
| $TlCl_2$ | (g) | 488–1200 | 19.487 | 31.713 | 31214 |
| $SF_6$ | (g) | >209 | 169.150 | 80.455 | 304244 |
| $SeF_6$ | (g) | >227 | 166.200 | 81.695 | 279064 |
| $TlF_6$ | (g) | 600–1200 | 162.870 | 82.523 | 339169 |
| $S_2$ | (g) | 500–1200 | 4.005 | 20.004 | −28035 |

TABLE 8-continued

G-values of impurities and their compounds $G_i = aT + bT\log T + c$, kcal/kmol

| Component | | ΔT, °K. | a | −b | −c |
|---|---|---|---|---|---|
| $Se_2$ | (g) | 600–1200 | 8.137 | 23.085 | −30050 |
| $Te_2$ | (g) | 600–1200 | 3.087 | 22.271 | −34890 |
| $Cl_2$ | (g) | 800–1200 | 6.570 | 20.455 | 2815 |
| $F_2$ | (g) | 800–1200 | 9.750 | 19.855 | 2786 |

TABLE 9

Equilibrium constants of reaction $(v/2)S_2(g)\ Sv(g)$ $Kv = \exp[AT^{-1} + B \ln T - c]$

| v | A | 10B | C |
|---|---|---|---|
| 3 | 5600 | 1.38 | 8.766 |
| 4 | 8305 | 5.86 | 19.095 |
| 5 | 25052 | 7.47 | 34.385 |
| 6 | 34055 | 11.66 | 46.851 |
| 7 | 41286 | 14.70 | 57.275 |
| 8 | 49943 | 19.68 | 70.414 |

$\Sigma P$, atm $= P_{S2} + P_{S2}^{3/2}K_3 + P_{S2}^{2}K_4 + P_{S2}^{5/2}K_5 + P_{S2}^{3}K_6 + P_{S2}^{7/2}K_7 + P_{S2}^{4}K_8$

TABLE 10

Values of the free energy of a sulfur mole as a function of the atomic number of the molecule $Gi = aT + 6T \ln T + cT^2 + dT^{-1} + e$, kcal/kmol

| i | a | −b | $-10^6c$ | $10^{-3}d$ | e |
|---|---|---|---|---|---|
| $S_2$ | 4.458 | 8.720 | 80.000 | 45.000 | 27841 |
| $S_3$ | 27.116 | 13.766 | 38.000 | 75.600 | 30387 |
| $S_4$ | 55.422 | 19.730 | 375.000 | 85.000 | 38515 |
| $S_5$ | 96.026 | 25.450 | 101.500 | 196.550 | 17614 |
| $S_6$ | 128.686 | 31.490 | 80.000 | 205.500 | 12826 |
| $S_7$ | 158.598 | 37.263 | 130.500 | 279.350 | 11606 |

TABLE 10-continued

Values of the free energy of a sulfur mole as a function of the atomic number of the molecule $Gi = aT + 6T \ln T + cT^2 + dT^{-1} + e$, kcal/kmol

| i | a | −b | $-10^6c$ | $10^{-3}d$ | e |
|---|---|---|---|---|---|
| $S_8$ | 192.020 | 43.302 | 110.500 | 272.300 | 8398 |

What is claimed is:

1. A process for the selective removal of impurities selected from the group comprising arsenic, selenium, bismuth, tellurium, and antimony, present in a raw material selected from sulfidic complex and mixed ores and concentrates containing copper, cobalt, nickel and iron as main metals, by decomposing and rearranging, at an elevated tmperature and a high partial pressure of elemental sulfur, minerals present in the raw material, in order to form new impurity compounds which pass into the gas phase, comprising subjecting the raw material to a gas atmosphere which, in addition to sulfur, contains a sulfur halide in order to halogenate the impurity compounds which have passed into the gas phase, and form stable halides which no longer affect the vaporization equilibrium.

2. The process of claim 1, wherein the temperature is 600° to 900° C.

3. The process of claim 1, comprising using a gas atmosphere in which the partial pressure of sulfur is at minimum 0.2 atm.

4. The process of claim 1, comprising using a gas atmosphere containing the halogen in a quantity which is at minimum approximately 80% of the quantity required for the complete halogenation of the impurities.

5. The process of claim 1, comprising feeding at least one element selected from the group comprising chlorine, fluorine, and sulfur compounds of the same to the gas atmosphere.

6. The process of claim 5, comprising controlling the thermal balance of the process by feeding into the gas atmosphere at least two different halogens or halogen compounds at a pre-determined mutual ratio.

7. The process of claim 1, wherein sulfur purified of the impurity components is recycled into the process.

* * * * *

UNITED STATES PATENT AND TRADEMARK OFFICE

CERTIFICATE OF CORRECTION

PATENT NO. : 4,242,124

DATED : December 30, 1980

INVENTOR(S) : Simo A. I. Makipirtti

It is certified that error appears in the above-identified patent and that said Letters Patent are hereby corrected as shown below:

Column 10, Line 46: "among ethers," should be --among others,--

Column 11, Line 67: "so do arsenic" should be --as do arsenic--

Column 18, Line 32: "concurrently" should be --cocurrently--

Column 19, Line 58: "$\Delta H_{3+f}$" should be --$\Delta H_{e+f}$--

Column 20, Line 15: "723.622" should be --723.662--

Column 20, Line 63: "$\Delta H_{3+f}$" should be --$\Delta H_{e+f}$--

Column 20, Line 67: "41.314X10-T" should be --$41.314 \times 10^{-3}$T--

Signed and Sealed this

*Twenty-second* Day of *September 1981*

[SEAL]

*Attest:*

GERALD J. MOSSINGHOFF

*Attesting Officer*

*Commissioner of Patents and Trademarks*